US011224913B2

(12) United States Patent
Auer et al.

(10) Patent No.: US 11,224,913 B2
(45) Date of Patent: Jan. 18, 2022

(54) HOLDING DEVICE FOR HOLDING A CASTING CORE IN A CASTING MOLD

(71) Applicant: Bayerische Motoren Werke Aktiengesellschaft, Munich (DE)

(72) Inventors: Robert Auer, Essenbach (DE); Matthias Hermsdorf, Landshut (DE); Dominik Schittenhelm, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/666,695

(22) Filed: Oct. 29, 2019

(65) Prior Publication Data

US 2020/0061699 A1 Feb. 27, 2020

Related U.S. Application Data

(63) Continuation of application No. PCT/EP2018/060451, filed on Apr. 24, 2018.

(30) Foreign Application Priority Data

May 2, 2017 (DE) ..... 10 2017 207 293.8

(51) Int. Cl.

| | |
|---|---|
| ***B22C 9/10*** | (2006.01) |
| ***B22C 21/14*** | (2006.01) |
| ***B22D 17/24*** | (2006.01) |
| ***B22C 9/06*** | (2006.01) |

(52) U.S. Cl.

CPC ..... *B22D 17/24* (2013.01); *B22C 9/06* (2013.01); *B22C 9/10* (2013.01); *B22C 9/108* (2013.01); *B22C 21/14* (2013.01)

(58) Field of Classification Search

CPC ..... B22C 9/10; B22C 9/108; B22C 21/14; B22D 17/24

See application file for complete search history.

(56) References Cited

U.S. PATENT DOCUMENTS

| | | | | |
|---|---|---|---|---|
| 1,403,467 | A * | 1/1922 | Courtot | B22C 21/14 164/399 |
| 2,985,930 | A * | 5/1961 | Hohlfelder, Jr. | B22C 21/14 164/398 |
| 3,662,816 | A | 5/1972 | Bishop et al. | |
| 4,487,246 | A | 12/1984 | Frasier | |
| 8,376,027 | B2 * | 2/2013 | Nakamura | B22C 21/14 164/369 |

(Continued)

FOREIGN PATENT DOCUMENTS

| | | |
|---|---|---|
| CN | 85 1 01949 A | 1/1987 |
| CN | 1468674 A | 1/2004 |

(Continued)

OTHER PUBLICATIONS

English translated Office Action issued in Chinese Application No. 201880015970.5 dated Jun. 19, 2020 (eight (8) pages).

(Continued)

*Primary Examiner* — Kevin E Yoon

(74) *Attorney, Agent, or Firm* — Crowell &. Moring, LLP

(57) ABSTRACT

A holding device for holding a casting core in a casting mold, especially in a die-casting mold, includes a plurality of clamping sections which are positioned in relation to each other in such a way that a clamping region for a casting core is formed.

17 Claims, 1 Drawing Sheet

(56) References Cited

U.S. PATENT DOCUMENTS

2004/0007344 A1 1/2004 Nakamura

FOREIGN PATENT DOCUMENTS

| | | | | |
|---|---|---|---|---|
| CN | 202461434 | U | | 10/2012 |
| DE | 470 283 | A | | 1/1929 |
| DE | 87 02 460 | U1 | | 6/1987 |
| DE | 87 05 460 | U1 | | 7/1987 |
| DE | 10 2005 023 732 | B3 | | 7/2006 |
| DE | 10 2015 216 224 | A1 | | 3/2017 |
| EP | 1 053 804 | A1 | | 11/2000 |
| JP | 4-288945 | A | | 10/1992 |
| JP | 2964670 | B2 | | 10/1999 |
| JP | 2004066249 | A | * | 3/2004 |
| JP | 2006102750 | A | * | 4/2006 |

OTHER PUBLICATIONS

International Search Report (PCT/ISA/210) issued in PCT Application No. PCT/EP2018/060451 dated Jul. 25, 2018 with English translation (six (6) pages).

German-language Written Opinion (PCT/ISA/237) issued in PCT Application No. PCT/EP2018/060451 dated Jul. 25, 2018 (seven (7) pages).

German-language Search Report issued in counterpart German Application No. 102017207293.8 dated May 23, 2017 with partial English translation (11 pages).

* cited by examiner

HOLDING DEVICE FOR HOLDING A CASTING CORE IN A CASTING MOLD

CROSS REFERENCE TO RELATED APPLICATIONS

This application is a continuation of PCT International Application No. PCT/EP2018/060451, filed Apr. 24, 2018, which claims priority under 35 U.S.C. § 119 from German Patent Application No. 10 2017 207 293.8, filed May 2, 2017, the entire disclosures of which are herein expressly incorporated by reference.

BACKGROUND AND SUMMARY OF THE INVENTION

The present invention relates to a holding device for holding a casting core, to a casting mold, to a method for fixing or holding a casting core, and to the use of a holding device.

Casting cores are required in cast parts in order to realize for example cavities and undercuts. Such cores, made for example of sand or salt, are currently used predominantly in gravity casting methods. In said methods, the cores are positioned by positioning pins or core supports or core bearings in the permanent mold or in the sand core (gravity casting). This inevitably results in a hole remaining in the cast part, said hole usually requiring finishing work. In die casting, it is possible to mount cores only via the support of the core via the mold halves and outside the cast part. This is due, inter alia, to the enormous pressure that the cores have to withstand without slipping. Consequently, the core subsequently protrudes from the cast part or the core supports remain as "foreign bodies" in the cast part.

Therefore, it is an object of the present invention to provide a holding device, a casting mold, a method for holding casting cores, and the use of a holding device, which remedy the abovementioned drawbacks and make it possible to optimize the known casting methods.

This object is achieved by a holding device, by a casting mold, by a method, and by the use according to the claimed invention.

According to the invention, a holding device for holding a casting core in a casting mold, in particular in a die casting mold, comprises a plurality of clamping portions that are positioned with respect to one another such that a clamping region is formed for a casting core or at least a region of a casting core. The clamping region forms, so to speak, a kind of arranging space, in or on which the casting core or at least a portion or region of the casting core can be arranged. With regard to the geometry of the clamping region, it should be mentioned that this is expediently adapted to a geometry of the casting core or of the corresponding portion or region of the casting core.

Preferably, the holding device or the clamping region is designed for the force-fitting, or form- and force-fitting arrangement of the casting core. Preferably, for holding or fixing the casting core by way of the holding device, an interference fit is provided. This interference fit allows the holding or fixing, and in particular the clamping, of the casting core. The design of the interference fit is dependent on the geometry and in particular on the material of the casting core. According to one embodiment, sand is used as the core material, wherein the cores are produced by means of core shooters or by means of additive manufacturing methods. Also known and usable are salt cores, ceramic fiber cores, glass or wood cores, and also fusible metal cores or hollow-body inserts and permanent steel inlays, which are likewise positionable, and in particular fixable, via the holding device.

It should be particularly emphasized at this point that the holding device is likewise designed for the force-fitting arrangement on the particular casting mold, which, depending on the casting method used, can be formed for example from metal or sand. In other words, the holding device is designed to bear both against the casting core and against the casting mold, or, depending on the configuration, against the corresponding mold halves etc., specifically in particular against the inner contour of the casting mold or against the outer contour of the casting core. This means in particular that, for example, no holes or the like for inserting the holding device have to be provided in the casting mold. According to one embodiment, the clamping portions form an, in particular coherent, lattice or web structure. Preferably, the clamping portions are formed in a weblike manner, wherein the wall thickness of the webs corresponds at least regionally to a component thickness or wall thickness of the subsequent cast part. Advantageously, a (minimum) wall thickness around the core can thus be set exactly by the dimensions of the holding device or of the clamping portions thereof. This can be particularly advantageous in particular when the component regions are those which are critical in terms of the tolerances to be achieved.

According to a preferred embodiment, a material of the holding device is identical or at least similar to a casting material that is used for producing cast parts. Expediently, the material of the holding device thus corresponds to that of the melt, thereby allowing better connection of the two components. According to one embodiment, the holding device can also be appropriately coated in order to further improve the connection, wherein the coating should be selected in a manner corresponding to the casting material used. Preferred casting materials are in particular aluminum and/or magnesium, or aluminum alloys and/or magnesium alloys. In the case of a coating, metal intermediate layers, for example zinc, can be applied for a substance-to-substance bond.

Alternatively, a material of the holding device can also be designed so as to deliberately influence the subsequent component properties of the cast part. According to one embodiment, a material is used for example for the holding device that allows the thermal conductivity of the component to be deliberately influenced in this region, in particular for example decreases or increases the latter. Optionally, the holding device can, for example when a steel material is used, increase the stiffness deliberately in a desired region of the cast part. Depending on the mass of the holding device, the natural frequency of the cast part can be influenced, etc.

Expediently, the clamping portions have inner contact faces and outer contact faces, wherein the inner contact faces are designed to bear against the casting core, and wherein the outer contact faces are designed to bear against the casting mold. The expression "to bear" should be understood here in particular as a differentiation from plugging into or engaging in the casting core or in the casting mold. The holding device is designed to be held or clamped in or via the casting mold, in other words to be arranged in particular in a force-fitting manner. In addition, the holding device is designed to hold the casting core itself or to be held or clamped or arranged in a force-fitting, and appropriately in a form-fitting manner, thereon. This ensures, in particular in die casting, that the casting core is fixed and held securely. To this end, for example the inner contact faces are each provided, oriented or arranged in a manner facing one another in pairs such that the casting core, or a particular portion of the casting core, can be arranged in the resultant "intermediate space"/arranging space (or plurality thereof). Expediently, the holding device comprises a plurality of such inner contact faces that are oriented with respect to one another in pairs, the position thereof being formed ultimately via the clamping portions.

According to one embodiment, at least one inner contact face is designed to bear against the casting core fully and in a form-fitting manner. Expediently, the inner contact face is designed to be arranged on the casting core fully, i.e. with its entire face, wherein the exact geometry of the inner contact face is dependent on the geometry of the casting core. The inner contact face can extend in a flat or even manner, but optionally also have rounded portions or form shoulders, in order to follow an external contour of the casting core—in a form-fitting manner—as exactly as possible.

According to one embodiment, at least one clearance or at least one recess is formed in at least one outer contact face. This makes it possible for the melt to be able to completely fill the space of the casting mold. In other words, the clearances or recesses optimally allow encapsulation of the holding device. Preferably, the size or number of outer contact faces, between the holding device and the casting mold, should be kept as low as possible or be reduced to a minimum.

According to various embodiments, such clearances and recesses can have a depth in a range of about 1-4 mm, wherein the dimensions thereof are dependent on the size of the cast component, but also on the parameters of the casting process. The recesses or clearances analogously form protrusions, which, in various embodiments, are cross-sectionally round, in particular circular, thereby making circulation easier. Alternatively, polygonal, for example square or rectangular, protrusions also create a chessboard-like structure with corresponding channels in between.

According to one embodiment, such clearances or recesses are also provided in one or more inner contact faces in order to optimize the complete filling of the casting mold. According to one embodiment, the holding device also has holes and/or openings, which are preferably oriented in the direction of flow of the melt and thus not only optimize the filling of the casting mold but also further improve the integral casting of the holding device.

The invention is also directed at a casting mold, in particular a die casting mold, comprising at least one casting core and at least one holding device according to the invention, wherein the at least one holding device is arranged between the at least one casting core and the casting mold, in particular in a force-fitting manner, i.e. in particular clamped or clamped in place. In this case, the casting mold can be a permanent mold, but also sand molds or in particular mold halves of die casting molds.

According to a preferred embodiment, an interference fit is provided between the at least one holding device and the casting core. This makes it possible for the holding device to be able to be clamped onto the casting core or onto a portion of a casting core.

Alternatively, the force-fit or the clamping action can also be realized only by the casting mold, in particular by the closing of the casting mold. For example, the holding device is slightly deformed or compressed during or by the closing of the casting mold, with the result that the force-fit between the casting core and the holding device is realized.

According to one embodiment, the clamping portions are arranged in a distributed manner separated from one another. In other words, the holding device does not comprise a plurality of coherent clamping portions, but rather the clamping portions are positioned or arranged in a manner distributed around the casting core and in a manner separated from one another such that the casting core is held securely. In this case, the clamping portions are configured for example as pins that bear against the casting core and the casting mold.

According to one embodiment, an interference fit is provided between the holding device and the casting mold. Expediently, the external dimensions of the holding device thus correspond, with a slight oversize, to the internal dimensions of the casting mold. In this way, the holding device together with the insert core is fixed or jammed in the casting mold when the casting mold is closed, i.e. in particular held in a force-fitting, or form- and force-fitting manner.

The invention is also directed at a method for fixing/holding a casting core, comprising the steps of:

providing a casting mold, in particular a die casting mold, and a casting core;

providing a holding device comprising a plurality of clamping portions;

arranging the holding device and/or the clamping portions between the casting mold and the casting core in order to fix the casting core.

Preferably, the arranging of the holding device and/or the clamping portions between the casting mold and the casting core is effected in order to minimize the free lengths of the core and thus to reduce the mechanical loading thereof during encapsulation.

Advantageously, it is possible to use cores without modifications or positioning aids, in particular on the die casting mold. Expediently, it is also no longer necessary for the cast part to be subjected to finishing work, since the holding device or the clamping portions no longer project out of the subsequent cast part and holes that are caused by for example core positioning aids no longer remain in the cast part. Therefore, as a result of the saving of time and work, the manufacturing costs are reduced. In particular, however, it is also possible at the same time for the quality of the components to be increased, since the holding device allows very rapid and in particular positionally accurate insertion of the casting cores. In particular the setting of the wall thickness by the holding device should be mentioned as being particularly advantageous. The quick and easy variation, possible in the present case, of the bearing points of the cores, which may require adaptation on account for example of particular flow conditions, should also be highlighted.

According to one embodiment, the method comprises the steps of: arranging/fixing the holding device on the casting core; and inserting the casting core into the casting mold.

Expediently, the holding device is first fixed to the casting core and this arrangement is then introduced into the casting mold.

According to one embodiment, the method also comprises the step of: closing the casting mold in order to fix the casting core and the holding device.

Preferably, an interference fit is provided between the holding device and the casting mold, i.e. the external dimensions of the holding device correspond, with a slight oversize, to the internal dimensions of the casting mold. In this way, the holding device together with the casting core can be fixed or jammed in the casting mold when the die casting mold is closed. In other words, preloading, so to speak, is applied by the casting mold.

The invention is also directed at the use of a holding device according to the invention in a die casting mold for core fixing.

Depending on the material and complexity of the holding device, the latter is produced for example by a subtractive manufacturing method. Preferably, production takes place by means of an additive manufacturing method.

The advantages and features mentioned in conjunction with the holding device also apply analogously and correspondingly to the method and to the use, and vice versa and between one another.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
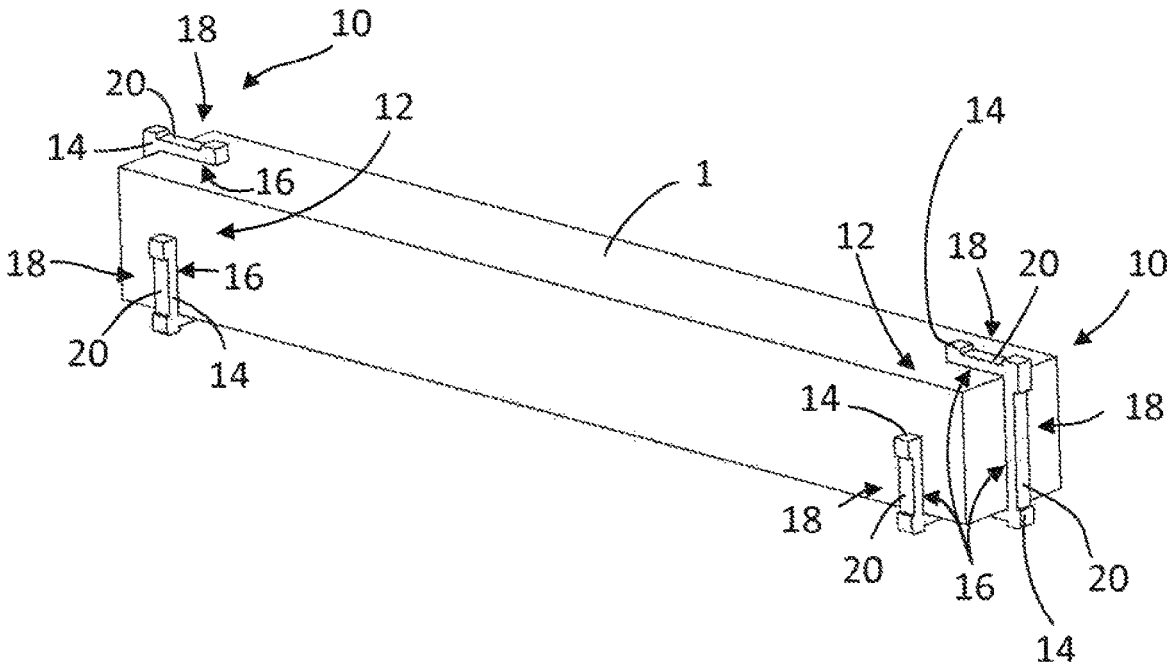
FIG. 1 is a perspective view of a casting core, held by two holding devices.

FIG. 1 shows a casting core 1, which has a substantially square cross section. At each of the ends of the casting core 1, a holding device 10 is arranged that has clamping portions 14. The clamping portions 14 are formed in a cohesive manner, wherein it should be noted that the casting core 1 partially covers some clamping portions. However, it is apparent that the clamping portions 14 are arranged preferably in pairs and opposite one another such that clamping or fixing of the casting core 1 can be realized, but, at the same time, also holding and fixing of the holding device 10 by a casting mold that is not shown here. The clamping portions 14 each form a clamping region 12, in which the casting core 1 or the end regions thereof are arranged. Facing the casting core 1, the clamping portions 14 comprise inner contact faces 16 and, on the opposite side, facing the casting mold that is not shown here, the clamping portions 14 comprise outer contact faces 18. It is apparent that in the contact faces 18 or, in the region of the contact faces 18, clearances or recesses 20 are formed such that it is possible for the melt to fill the frame of the casting mold as completely as possible. In this way, the holding devices 10 expediently remain in the subsequent cast part.

Figure 2:
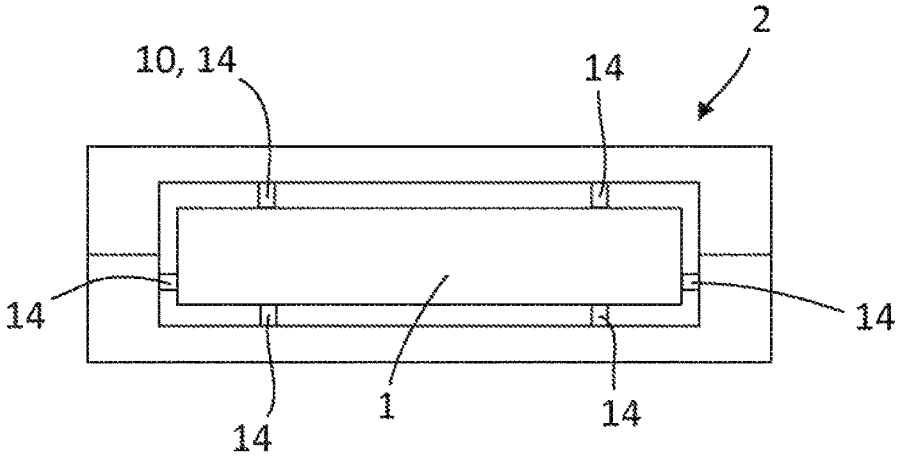
FIG. 2 is a schematic sectional view of a casting mold together with a casting core, fixed via a holding device.

FIG. 2 shows a schematic sectional illustration of a casting core 1, arranged in a casting mold 2, which has an upper mold half and a lower mold half in the outline view shown here. A holding device is outlined, comprising a plurality of clamping portions 14, which, unlike in FIG. 1, are not formed in a cohesive manner. The clamping portions 14 are for example individual pins which fit between the casting core 1 and the casting mold 2.

It is apparent both from FIG. 1 and from FIG. 2 that the casting core 1 and the casting mold 2 do not have, or do not have to have, any modifications or positioning aids. Advantageously, the holding device(s) can be arranged between the casting core 1 and the casting mold 2 without geometric modifications to the casting core 1 or the casting mold 2 being necessary for this purpose. This is realized in particular by the clamping action between the inner contact faces 16 and the casting core 1 and the outer contact faces 18 and the casting mold 2, respectively.

LIST OF REFERENCE SIGNS

1 Casting core
2 Casting mold
10 Holding device
12 Clamping region
14 Clamping portion
16 Inner contact face
18 Outer contact face
20 Clearance The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A holding device for holding a casting core in a casting mold, comprising:

a plurality of clamping portions, wherein the plurality of clamping portions are each a separate structure, wherein the separate structures are arranged in respective pairs opposite one another to form a respective clamping region for the casting core, and wherein a first clamping portion of a respective pair is oriented perpendicularly to a second clamping Portion of the respective pair;

wherein each of the plurality of clamping portions has a first member and a second member wherein the first and second members longitudinally extend perpendicularly to each other in different respective planes;

wherein each of the first member and the second member has an inner contact face configured to bear against the casting core and an outer contact face configured to bear against the casting mold, wherein the respective inner contact faces of the first and second clamping portions of the respective pair face the respective clamping region;

wherein the inner contact face is disposed on a first side of the respective member and the outer contact face is disposed on a second side of the respective member wherein the first side is opposite from the second side.

2. The holding device according to claim 1, wherein the clamping region is configured for a force-fitting arrangement of the casting core.

3. The holding device according to claim 1, wherein the plurality of clamping portions form a lattice structure or web structure.

4. The holding device according to claim 1, wherein a material of the holding device is identical or similar to a casting material that is used for producing cast parts.

5. The holding device according to claim 1, wherein the respective inner contact faces are configured to bear against the casting core fully and in a form-fitting manner.

6. The holding device according to claim 1, wherein a respective recess is formed in the respective outer contact faces.

7. A casting mold, comprising:

at least one casting core; and at least one holding device according to claim 1, wherein the at least one holding device is arranged between the at least one casting core and the casting mold.

8. The casting mold according to claim 7, wherein the mold is a die casting mold.

9. The casting mold according to claim 7, wherein the at least one holding device is arranged between the at least one casting core and the casting mold in a force-fitting manner.

10. The casting mold according to claim 7, wherein an interference fit is provided between the at least one holding device and the casting core.

11. The casting mold according to claim 10, wherein an interference fit is provided between the holding device and the casting mold.

12. The casting mold according to claim 7, wherein an interference fit is provided between the holding device and the casting mold.

13. A method for fixing/holding a casting core, comprising the steps of:

providing a casting mold and a casting core;

providing a holding device according to claim 1;

arranging the holding device between the casting mold and the casting core in order to fix the casting core.

14. The method according to claim 13, wherein the casting mold is a die casting mold.

15. The method according to claim 13, further comprising the steps of:

arranging the holding device on the casting core;

inserting the casting core into the casting mold.

16. The method according to claim 15, further comprising the step of:

closing the casting mold in order to fix the casting core and the holding device.

17. The use of a holding device according to claim 1 in a die casting mold for core fixing.

* * * * *